US006144316A

United States Patent [19]

Skinner

[11] Patent Number: 6,144,316

[45] Date of Patent: Nov. 7, 2000

[54] ELECTROMAGNETIC AND ACOUSTIC REPEATER AND METHOD FOR USE OF SAME

[75] Inventor: Neal G. Skinner, Lewisville, Tex.

[73] Assignee: Halliburton Energy Services, Inc., Dallas, Tex.

[21] Appl. No.: 08/980,614

[22] Filed: Dec. 1, 1997

[51] Int. Cl.[7] ..... G01V 3/00

[52] U.S. Cl. ..... 340/853.7; 340/853.3; 367/83

[58] Field of Search ..... 340/853.7, 853.3, 340/856.4; 367/81, 82, 83

[56] References Cited

U.S. PATENT DOCUMENTS

| | | | |
|---|---|---|---|
| 2,379,800 | 7/1945 | Hare | 175/356 |
| 2,411,696 | 11/1946 | Silverman et al. | 177/352 |
| 3,186,222 | 6/1965 | Martin | 73/151 |
| 3,205,477 | 9/1965 | Kalbfell | 340/18 |
| 3,227,228 | 1/1966 | Bannister | 175/4 |
| 3,233,674 | 2/1966 | Leutwyler | 166/63 |
| 3,333,239 | 7/1967 | Silverman | 340/18 |
| 3,930,220 | 12/1975 | Shawhan | 340/18 FM |
| 4,019,148 | 4/1977 | Shawhan | 328/167 |
| 4,087,781 | 5/1978 | Grossi et al. | 340/18 NC |
| 4,181,014 | 1/1980 | Zuvela et al. | 73/151 |
| 4,215,426 | 7/1980 | Klatt | 367/83 |
| 4,293,936 | 10/1981 | Cox et al. | 367/82 |
| 4,293,937 | 10/1981 | Sharp et al. | 367/82 |
| 4,298,970 | 11/1981 | Shawhan et al. | 367/82 |
| 4,302,757 | 11/1981 | Still | 340/854 |
| 4,320,473 | 3/1982 | Smither et al. | 367/82 |
| 4,348,672 | 9/1982 | Givier | 340/854 |
| 4,363,137 | 12/1982 | Salisbury | 455/40 |
| 4,373,582 | 2/1983 | Bednar et al. | 166/65 R |
| 4,387,372 | 6/1983 | Smith et al. | 340/854 |
| 4,406,919 | 9/1983 | Pospischil | 178/69 G |
| 4,468,665 | 8/1984 | Thawley et al. | 340/856 |
| 4,496,174 | 1/1985 | McDonald et al. | 285/53 |
| 4,525,715 | 6/1985 | Smith | 340/854 |
| 4,562,559 | 12/1985 | Sharp et al. | 367/82 |
| 4,578,675 | 3/1986 | MacLeod | 340/855 |
| 4,616,702 | 10/1986 | Hanson et al. | 166/65.1 |
| 4,617,960 | 10/1986 | More | 137/554 |
| 4,684,946 | 8/1987 | Issenmann | 340/855 |
| 4,691,203 | 9/1987 | Rubin et al. | 340/856 |
| 4,725,837 | 2/1988 | Rubin | 340/855 |
| 4,739,325 | 4/1988 | MacLeod | 340/854 |
| 4,757,157 | 7/1988 | Pelet | 174/50 |
| 4,766,442 | 8/1988 | Issenmann | 343/719 |
| 4,788,544 | 11/1988 | Howard | 340/853 |
| 4,800,570 | 1/1989 | Perrotta et al. | 375/4 |
| 4,839,644 | 6/1989 | Safinya et al. | 340/854 |
| 4,845,493 | 7/1989 | Howard | 340/853 |
| 4,901,069 | 2/1990 | Veneruso | 340/853 |
| 4,908,804 | 3/1990 | Rorden | 367/81 |
| 4,933,640 | 6/1990 | Kuckes | 324/339 |

(List continued on next page.)

FOREIGN PATENT DOCUMENTS

| | | |
|---|---|---|
| 0 672 819 A2 | 9/1995 | Norway . |
| 2 281 424 | 1/1996 | United Kingdom . |

*Primary Examiner*—Michael Horabik
*Assistant Examiner*—Timothy Edwards, Jr.
*Attorney, Agent, or Firm*—Paul I. Herman; Lawerence R. Youst

[57] ABSTRACT

An electromagnetic and acoustic signal repeater (34) for communicating information between surface equipment and downhole equipment and a method for use of the repeater (34) is disclosed. The repeater (34) comprises an electromagnetic receiver (48) and an acoustic receiver (49) for respectively receiving and transforming electromagnetic input signals (46) and acoustic input signals into electrical signals that are processed and amplified by an electronics package (50) that generates an electrical output signal that is forwarded to an electromagnetic transmitter (52) and an acoustic transmitter (51) for respectively generating an electromagnetic output signal (53) that is radiated into the earth and an acoustic output signal that is acoustically transmitted.

21 Claims, 7 Drawing Sheets

U.S. PATENT DOCUMENTS

| | | | |
|---|---|---|---|
| 4,968,978 | 11/1990 | Stolarczyk | 340/854 |
| 5,087,099 | 2/1992 | Stolarczyk | 299/1 |
| 5,130,706 | 7/1992 | Van Steenwyk | 340/854.6 |
| 5,160,925 | 11/1992 | Dailey et al. | 340/853.3 |
| 5,268,683 | 12/1993 | Stolarczyk | 340/854.4 |
| 5,394,141 | 2/1995 | Soulier | 340/854.4 |
| 5,396,232 | 3/1995 | Mathieu et al. | 340/854.5 |
| 5,448,227 | 9/1995 | Orban et al. | 340/854.4 |
| 5,467,083 | 11/1995 | McDonald et al. | 340/854.6 |
| 5,467,832 | 11/1995 | Orban et al. | 175/45 |
| 5,493,288 | 2/1996 | Henneuse | 340/854.4 |
| 5,530,358 | 6/1996 | Wisler et al. | 324/338 |
| 5,576,703 | 11/1996 | MacLeod et al. | 340/854.4 |
| 5,583,504 | 12/1996 | Huggett | 342/15 |
| 5,691,712 | 11/1997 | Meek et al. | 3340/853.3 |
| 5,914,911 | 6/1999 | Babour et al. | 367/82 |

ELECTROMAGNETIC AND ACOUSTIC REPEATER AND METHOD FOR USE OF SAME

TECHNICAL FIELD OF THE INVENTION

The present invention relates in general to downhole telemetry and in particular to the use of electromagnetic and acoustic signal repeaters for communicating information between downhole equipment and surface equipment.

BACKGROUND OF THE INVENTION

Without limiting the scope of the present invention, its background will be described with reference to transmitting downhole data to the surface during a measurement while drilling ("MWD") operation. The principles of the present invention, however, are applicable not only during the drilling process, but throughout the utilization of the fluid or gas extraction well including, but not limited to, logging, testing, completing and producing the well.

In the past, a variety of communication and transmission techniques have been attempted in order to provide real time data from the vicinity of the drill bit to the surface during the drilling operation or during the production process. The utilization of Measurement While Drilling ("MWD") with real time data transmission provides substantial benefits during a (drilling operation that enable increased control of the process. For example, continuous monitoring of downhole conditions allows for a timely response to possible well control problems and improves operational response to problems and potential problems as well as optimization of controllable drilling and production parameters during the drilling and operation phases.

Measurement of parameters such as bit weight, torque, wear and bearing condition on a real time basis provides the means for a more efficient drilling operation. Increased drilling rates, better trip planning, reduced equipment failures, fewer delays for directional surveys, and the elimination of the need to interrupt drilling operations for abnormal pressure detection are achievable using MWD techniques.

At present, there are four categories of telemetry systems have been utilized in attempts to provide real time data from the vicinity of the drill bit to the drilling platform or to the facility controlling the drilling and production operation. These techniques include mud pressure pulses, insulated conductors, acoustics and electromagnetic waves.

In a mud pressure pulse transmission system, resistance of mud flow through a drill string is modulated by means of a valve and control mechanism mounted in a specially adapted drill collar near the bit. Pressure Pulse transmission mechanisms are relatively slow in terms of data transmission of measurements due to pulse spreading, modulation rate limitations, and other disruptive limitations such as the requirement of mud flow. Generally, pressure pulse transmission systems are is normally limited to transmission rates of 1 to 2 bits per second.

Alternatively, insulated conductors, or hard wire connections from the bit to the surface, provide a method for (establishing downhole communications. These systems may be capable of a high data rate and, in addition, provide for the possibility of two way communication. However insulated conductors and hard wired systems require a especially adapted drill pipe and special tool joint connectors which substantially increase the cost of monitoring a drilling or production operation. Furthermore, insulated conductor and hard wired systems are prone to failure as a result of the severe down-hole environmental conditions such as the abrasive conditions of the mud system, extreme temperatures, high pressures and the wear caused by the rotation of the drill string.

Acoustic systems present a third potential means of data transmission. An acoustic signal generated near the bit, or particular location of interest, is transmitted through the drill pipe, mud column or the earth. However, due to downhole space and environmental constraints, the low intensity of the signal which can be generated downhole, along with the acoustic noise generated by the drilling system, makes signal transmission and detection difficult over long distances. In the case where the drill string is utilized as the primary transmission medium, reflective and refractive interferences resulting from changing diameters and the geometry of the connections at the tool and pipe joints, compound signal distortion and detection problems when attempts are made to transmit a signal over long distances.

The fourth technique used to telemeter downhole data to surface detection and recording devices utilizes electromagnetic ("EM") waves. A signal carrying downhole data is input to a toroid or collar positioned adjacent to the drill bit or input directly to the drill string. When a toroid is utilized, a primary winding, carrying the data for transmission, is wrapped around the toroid and a secondary is formed by the drill pipe. A receiver is connected to the ground at the surface where the electromagnetic data is picked up and recorded. However, in deep or noisy well applications, conventional electromagnetic systems are often unable to generate a signal with sufficient intensity and clarity to reach the desired reception location with sufficient strength for accurate reception. Additionally, in certain applications where the wellbore penetrates particular strata, for example, a high salt concentration, transmission of data via EM over any practical distance is difficult or impossible due to ground and electrochemical effects.

Thus, there is a need for a downhole communication and data transmission system that is capable of transmitting data between a surface location and equipment located in the vicinity of the drill bit, or another selected location in the wellbore. A need has also arisen for such a communication system that is capable of operation in a deep or noisy well or in a wellbore penetrating formations that preclude or interfere with the use of known techniques for communication.

SUMMARY OF THE INVENTION

The present invention disclosed herein comprises downhole repeaters that utilizes electromagnetic and acoustic waves to retransmit signals carrying information and the method for use of the same. The repeater and method of the present invention provide for real time communication between downhole equipment and the surface and for the telemetering of information and commands from the surface to downhole tools disposed in a well using both electromagnetic and acoustic waves to carry information. The repeater and method of the present invention serve to detect and amplify the signals carrying information at various depths in the wellbore, thereby alleviating signal attenuation.

The repeater of the present invention comprises an electromagnetic receiver for receiving an electromagnetic input signal and transforming the electromagnetic input signal to a first electrical signal and an acoustic receiver for receiving an acoustic input signal and transforming the acoustic input signal to a second electrical signal. The first and second electrical signals are forwarded to an electronics package for processing and generating an electrical output signal. The repeater of the present invention also includes an acoustic transmitter for transforming the electrical output signal to an acoustic output signal and an electromagnetic transmitter for transforming the electrical output signal to an electromagnetic output signal.

The electromagnetic receivers and transmitters may comprise a magnetically permeable annular core, a plurality of primary electrical conductor windings wrapped axially around the annular core and a plurality of secondary electrical conductor windings wrapped axially around the annular core and magnetically coupled to the plurality of primary electrical conductor windings. Alternatively, the electromagnetic transmitters may comprise a pair of electrically isolated terminals each of which are electrically connected to the electronics package.

The acoustic receivers and transmitters may comprise a plurality of piezoelectric elements. The electronics package may include an annular carrier having a plurality of axial openings for receiving a battery pack and an electronics member having a plurality of electronic devices thereon for processing and amplifying the electrical signals.

The method of the present invention comprises receiving an electromagnetic input signal on an electromagnetic receiver that transforms the electromagnetic input signal into an electrical signal that is sent to an electronics package and receiving an acoustic input signal on an acoustic receiver that transforms the acoustic input signal into an electrical signal that is sent to the electronics package. The electronics package processes the electrical signals and sends an electrical output signal to an acoustic transmitter that transforms the electrical signal into an acoustic output signal. The electronics package also sends an electrical output signal to an electromagnetic transmitter that transforms the electrical signal into an electromagnetic output signal.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
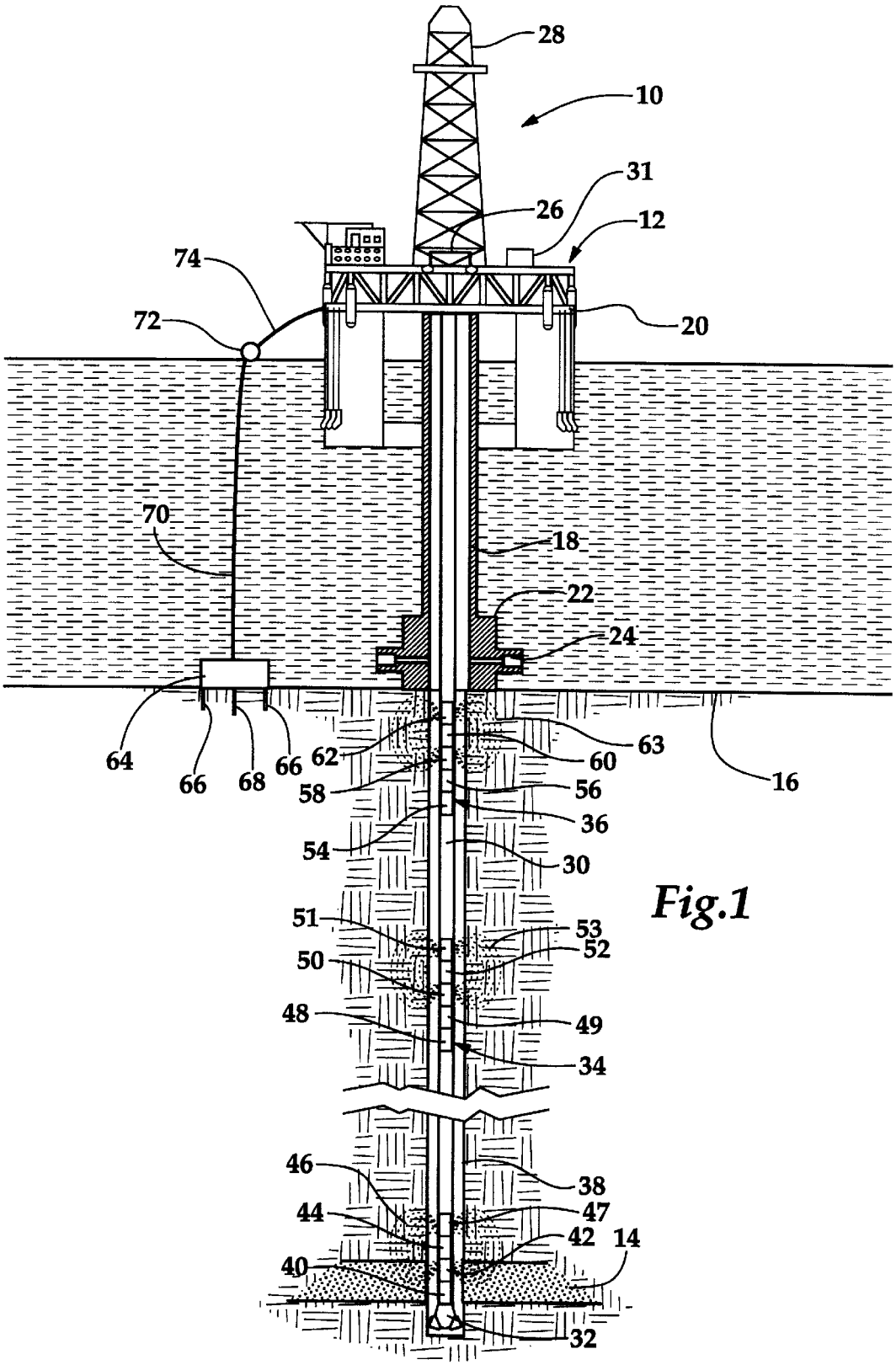
FIG. 1 is a schematic illustration of a telemetry system operating an electromagnetic and acoustic signal repeater of the present invention.

Referring now to FIG. 1, a downhole communication system in use on an offshore oil and gas drilling platform is schematically illustrated and generally designated 10. A semi-submergible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering drill string 30, including drill bit 32 and electromagnetic and acoustic signal repeaters 34, 36.

In a typical drilling operation, drill bit 32 is rotated by drill string 30, such that drill bit 32 penetrates through the various earth strata, forming wellbore 38. Measurement of parameters such as bit weight, torque, wear and bearing conditions may be obtained by sensors 40 located in the vicinity of drill bit 32. Additionally, parameters such as pressure and temperature as well as a variety of other environmental and formation information may be obtained by sensors 40. The signal generated by sensors 40 may typically be analog, which must be converted to digital data before electromagnetic transmission in the present system. The signal generated by sensors 40 is passed into an electronics package 42 including an analog to digital converter which converts the analog signal to a digital code.

Electronics package 42 may also include electronic devices such as an on/off control, a modulator, a microprocessor, memory and amplifiers. Electronics package 42 is powered by a battery pack which may include a plurality of batteries, such as nickel cadmium, lithium batteries, alkaline or other suitable power supply, which are configured to provide proper operating voltage and current.

Once the electronics package 42 establishes the frequency, power and phase output of the information, 20 electronics package 42 feeds the information to transmitters 44, 47. Transmitter 44 may be a direct connect to drill string 30 or may electrically approximate a large transformer. Transmitter 44 transmits information uphole in the form of electromagnetic wave fronts 46 which travel through the earth. These electromagnetic wave fronts 46 are picked up by a receiver 48 of repeater 34 located uphole from transmitter 44. transmitter 47 may comprise a transducer in the form of a stack of piezoelectric ceramic crystals. Transmitter 47 generates an acoustic signal that travels up drill string 30. The acoustic signal is picked up by receiver 49 of repeater 34.

Receiver 48 of repeater 34 is spaced along drill string 30 to receive the electromagnetic wave fronts 46 while electromagnetic wave fronts 46 remain strong enough to be readily detected. Receiver 48 may electrically approximate a large transformer as will be discussed with reference to FIGS. 5 and 7. As electromagnetic wave fronts 46 reach receiver 48, a current is induced in receiver 48 that carries the information originally obtained by sensors 40. The current is fed to an electronics package 50 that may include a variety of electronic devices such as a preamplifier, a limiter, a plurality of filters, a frequency to voltage converter, a voltage to frequency converter and amplifiers as will be further discussed with reference to FIGS. 9 and 11. Electronics package 50 cleans up and amplifies the signal to reconstruct the original waveform, compensating for losses and distortion occurring during the transmission of electromagnetic wave fronts 46 through the earth.

Receiver 49 of repeater 34 is positioned to receive the acoustic signals transmitted along drill string 30 at a point where the acoustic signals are of a magnitude sufficient for adequate reception. Receiver 49 may comprise a transducer in the form of a stack of piezoelectric ceramic crystals as described in greater detail with reference to FIG. 4. As the acoustic signals reach receiver 49, the signals are converted to an electrical current which represents the information originally obtained by sensors 40. The current is fed to an electronics package 50 for processing and amplification to reconstruct the original waveform, compensating for losses and distortion occurring during the transmission of the acoustic signal.

Electronics package 50 may include a comparator for comparing the relative strength and clarity of the electromagnetic signal versus the acoustic signal. The electronics package 50 may also include time delay and detection features to allow for any differences in the transmission rates of the electromagnetic and acoustic signals. Alternatively, the signals generated by electromagnetic transmitter 44 and acoustic transmitter 47 may include a "transmission completed" code to enable the electronics package 50 to determine when the respective transmissions are completed.

Electronics package 50 may select the stronger of the two signals for retransmission and simultaneously transmits a signal corresponding to the selected signal to electromagnetic transmitter 52 and acoustic transmitter 51, which, in turn generate electromagnetic wave fronts 53 and acoustic signals. Alternatively, the two signals may be electronically filtered and combined to produce a hybrid signal for retransmission. Also, it should be noted that the electromagnetic and acoustic signals received by repeater 34 may be compared to determined whether both signals contain the identical information as a check of the validity of the transmitted data. As previously noted, the signals may include a "signal complete" code to indicate to the receiving device that the transmission has been completed.

Electromagnetic wave fronts 53 and the acoustic signal are transmitted by repeater 34 and are received respectively by electromagnetic receiver 54 and acoustic receiver 56 of repeater 36. Repeater 36 includes electromagnetic receiver 54, acoustic receiver 56, electronics package 58, electromagnetic transmitter 60 and acoustic transmitter 62, each of which operates as those described with reference to repeater 34.

Electromagnetic wave fronts 63 generated by electromagnetic transmitter 60 are detected by electromagnetic pickup device 64 located on sea floor 16. Electromagnetic pickup device 64 may sense either the electric field or the magnetic field of electromagnetic wave front 63 using an electric field sensor 66, a magnetic field sensor 68 or both. The electromagnetic pickup device 64 serves as a transducer transforming electromagnetic wave front 63 into an electrical signal using a plurality of electronic devices. The electrical signal may be sent to the surface on wire 70 that is attached to buoy 72 and onto platform 12 for further processing via wire 74. Upon reaching platform 12, the information originally obtained by sensors 40 is further processed making any necessary calculations and error corrections such that the information may be displayed in a usable format.

Acoustic signals generated by acoustic transmitter 62 are detected by acoustic receiver 31 that is electrically connected to a stack of piezoelectric ceramic crystals located on the top of drill string 30. Alternatively, the acoustic signals may be transmitted through the fluid in the annulus around drill string 30 and received in the moon pool of platform 12. Upon receipt of the acoustic signal, the information originally obtained by sensors 40 is further processed making any necessary calculations and error corrections such that the information may be displayed in a useable form. As should be apparent to those skilled in the art, the strength and clarity of the electromagnetic and acoustic signals received at the platform 12 may be compared and the stronger or clearer signal may be selected for processing. Alternatively, the two signals may be electronically filtered and combined to produce a hybrid signal for further processing. Also, the electromagnetic and acoustic signals received at the platform 12 may be compared to determined whether both signals contain the identical information as a check of the validity of the transmitted data.

Even though FIG. 1 depicts two repeaters 34 and 36, it should be noted by one skilled in the art that the number of repeaters located within drill string 30 will be determined by the depth of wellbore 38, the noise level in wellbore 38 and the characteristics of the earth's strata adjacent to wellbore 38 in that electromagnetic and acoustic waves suffer from attenuation with increasing distance from their source at a rate that is dependent upon the composition characteristics of the transmission medium and the frequency of transmission. For example, electromagnetic and acoustic signal repeaters, such as electromagnetic and acoustic signal repeaters 34, 36 may be positioned between 3,000 and 5,000 feet apart. Thus, if wellbore 38 is 15,000 feet deep, between two and four repeaters may be desirable.

Additionally, while FIG. 1 has been described with reference to transmitting information uphole during a measurement while drilling operation, it should be understood by one skilled in the art that repeaters 34, 36 may be used in conjunction with the transmission of information downhole from surface equipment to downhole tools to perform a variety of functions such as opening and closing a downhole tester valve or controlling a downhole choke.

Further, even though FIG. 1 has been described with reference to one way communication from the vicinity of drill bit 32 to platform 12, it will be understood by one skilled in the art that the principles of the present invention are applicable to two way communication. For example, a surface installation may be used to request downhole pressure, temperature, or flow rate information from formation 14 by sending acoustic or electromagnetic signals downhole which would be amplified as described above with reference to repeaters 34, 36. Sensors, such as sensors 40, located near formation 14 receive this request and obtain the appropriate information which would then be returned to the surface via electromagnetic and acoustic signals which would again be amplified as described above with reference to repeaters 34, 36. As such, the phrase "between surface equipment and downhole equipment" as used herein encompasses the Transmission of information from surface equipment downhole, from downhole equipment uphole, or for two way communication.

Whether the information is being sent from the surface to a downhole destination or a downhole location to the surface, electromagnetic wave fronts and acoustic signals may be radiated at varying frequencies such that the appropriate receiving device or devices detect that the signal is intended for the particular device. Additionally, repeaters 34 and 36 may include blocking switches which prevents the receivers from receiving signals while the associated transmitters are transmitting.

Even though FIG. 1 has been described with reference to an offshore environment, it should be understood by one skilled in the art that the principles described herein are equally well-suited for an onshore environment. In fact, in an onshore operation, electromagnetic pickup device 64 would be placed directly on the land surface.

The above-described embodiment of the invention, by using parallel electromagnetic and acoustic signal transmission, allows for the optimization of signal transmission in terms of rate, strength and clarity. The use of a downhole communications system for a deep well requiring multiple repeaters, based solely upon either electromagnetic or acoustic repeaters, requires that each repeater, whether acoustic-to-acoustic or electromagnetic-to-electromagnetic, ease transmission before receiving data and likewise cease reception while transmitting data due to interference between the transmitted and received signals.

Since the repeaters in an a downhole communication system based solely upon acoustic-to-acoustic or electromagnetic-to-electromagnetic transmissions cannot simultaneously receive and transmit data, transmission of data is inevitably delayed. The present invention may alleviate the delay inherent in a downhole communication system based solely upon acoustic-to-acoustic or electromagnetic-to-electromagnetic transmissions in that an electromagnetic receiver may receive while an acoustic transmitter of a repeater transmits and an acoustic receiver may receive while an electromagnetic transmitter of a repeater transmits, thereby allowing the repeaters to simultaneously transmit and receive data.

Figure 2A:
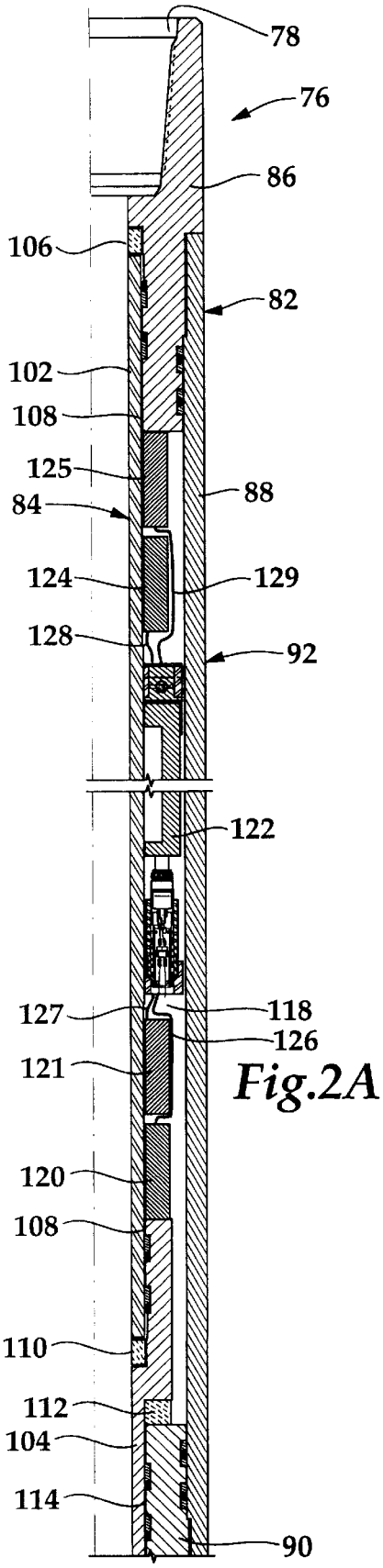
FIGS. 2A–2B are quarter-sectional views of an electromagnetic and acoustic repeater of the present invention.
Figure 2B:
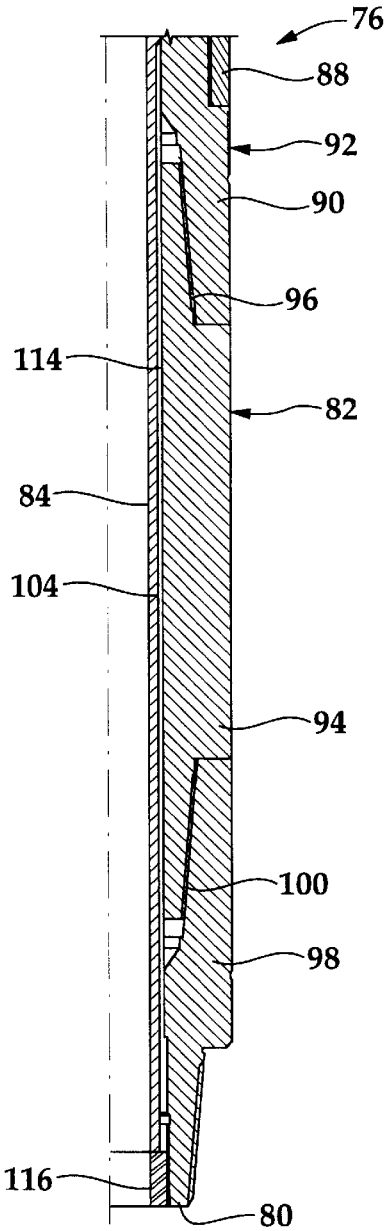

Referring now to FIGS. 2A–2B, one embodiment of a repeater 76 of the present invention is illustrated. For convenience of illustration, repeater 76 is depicted in a quarter sectional view. Repeater 76 has a box end 78 and a pin end 80 such that repeater 76 is threadably adaptable to drill string 30. Repeater 76 has an outer housing 82 and a mandrel 84 having a full bore so that when repeater 76 is interconnected with drill string 30, fluids may be circulated therethrough and therearound. Specifically, during a drilling operation, drilling mud is circulated through drill string 30 inside mandrel 84 of repeater 76 to ports formed through drill bit 32 and up the annulus formed between drill string 30 and wellbore 38 exteriorly of housing 82 of repeater 76. Housing 82 and mandrel 84 thereby protect to operable components of repeater 76 from drilling mud or other fluids disposed within wellbore 38 and within drill string 30.

Housing 82 of repeater 76 includes an axially extending and generally tubular upper connecter 86 which has box end 78 formed therein. Upper connecter 86 may be threadably and sealably connected to drill string 30 for conveyance into wellbore 38.

An axially extending generally tubular intermediate housing member 88 is threadably and sealably connected to upper connecter 86. An axially extending generally tubular lower housing member 90 is threadably and sealably connected to intermediate housing member 88. Collectively, upper connecter 86, intermediate housing member 88 and lower housing member 90 form upper subassembly 92. Upper subassembly 92, including upper connecter 86, intermediate housing member 88 and lower housing member 90, is electrically connected to the section of drill string 30 above repeater 76.

An axially extending generally tubular isolation subassembly 94 is securably and sealably coupled to lower housing member 90. Disposed between isolation subassembly 94 and lower housing member 90 is a dielectric layer 96 that provides electric isolation between lower housing member 90 and isolation subassembly 94. Dielectric layer 96 is composed of a dielectric material, such as aluminum oxide, chosen for its dielectric properties and capably of withstanding compression loads without extruding.

An axially extending generally tubular lower connecter 98 is securably and sealably coupled to isolation subassembly 94. Disposed between lower connecter 98 and isolation subassembly 94 is a dielectric layer 100 that electrically isolates lower connecter 98 from isolation subassembly 94. Lower connecter 98 is adapted to threadably and sealably connect to drill string 30 and is electrically connected to the portion of drill string 30 below repeater 76.

Isolation subassembly 94 provides a discontinuity in the electrical connection between lower connecter 98 and upper subassembly 92 of repeater 76, thereby providing a discontinuity in the electrical connection between the portion of drill string 30 below repeater 76 and the portion of drill string 30 above repeater 76.

It should be apparent to those skilled in the art that the use of directional terms such as above, below, upper, lower, upward, downward, etc. are used in relation to the illustrative embodiments as they are depicted in the figures, the upward direction being towards the top of the corresponding figure and the downward direction being toward the bottom of the corresponding figure. It is to be understood that repeater 76 may be operated in vertical, horizontal, inverted or inclined orientations without deviating from the principles of the present invention.

Mandrel 84 includes axially extending generally tubular upper mandrel section 102 and axially extending generally tubular lower mandrel section 104. Upper mandrel section 102 is partially disposed and sealing configured within upper connecter 86. A dielectric member 106 electrically isolates upper mandrel section 102 from upper connecter 86. The outer surface of upper mandrel section 102 has a dielectric layer 108 disposed thereon. Dielectric layer 108 may be, for example, a teflon layer. Together, dielectric layer 108 and dielectric member 106 serve to electrically isolate upper connecter 86 from upper mandrel section 102.

Between upper mandrel section 102 and lower mandrel section 104 is a dielectric member 110 that, along with dielectric layer 108 serves to electrically isolate upper mandrel section 102 from lower mandrel section 104. Between lower mandrel section 104 and lower housing member 90 is a dielectric member 112. On the outer surface of lower mandrel section 104 is a dielectric layer 114 which, along with dielectric member 112 provide for electric isolation of lower mandrel section 104 from lower housing member 90. Dielectric layer 114 also provides for electric isolation between lower mandrel section 104 and isolation subassembly 94 as well as between lower mandrel section 104 and lower connecter 98. Lower end 116 of lower mandrel section 104 is disposed within lower connecter 98 and is in electrical communication with lower connecter 98. Intermediate housing member 88 of outer housing 82 and upper mandrel section 102 of mandrel 84 define annular area 118. An electromagnetic receiver 120, an acoustic receiver 121, an electronics package 122, an electromagnetic transmitter 124 and an acoustic transmitter 125 are disposed within annular area 118.

In operation, repeater 76 may, for example, serve as electromagnetic and acoustic repeater 34 of FIG. 1. Receiver 120 receives an electromagnetic input signal carrying information which is transformed into a electrical signal that is passed onto electronics package 122 via electrical conductor 126, as will be more fully described with reference to FIG. 5. Receiver 121 receives an acoustic input signal carrying information which is transformed into a electrical signal that is passed onto electronics package 122 via electrical conductor 127, as will be more fully described with reference to FIG. 4.

Electronics package 122 may select the stronger of the two signals for retransmission or may process both the received electromagnetic signal and acoustic signal. In either approach, electronics package 122 processes and amplifies the electrical signal for retransmission as will be more fully discussed with reference to FIG. 12. Electronics package 122 sends the electrical signal to acoustic transmitter 125 via electrical conductor 129 wherein the electrical signal is transformed into an acoustic output signal carrying information that is transmitted via drill string 30. Electronics package 122 also sends an electrical signal to electromagnetic transmitter 124 via electrical conductor 128. Electromagnetic transmitter 124 transforms the electrical signal into an electromagnetic output signal carrying information that is radiated into the earth.

Figure 3A:
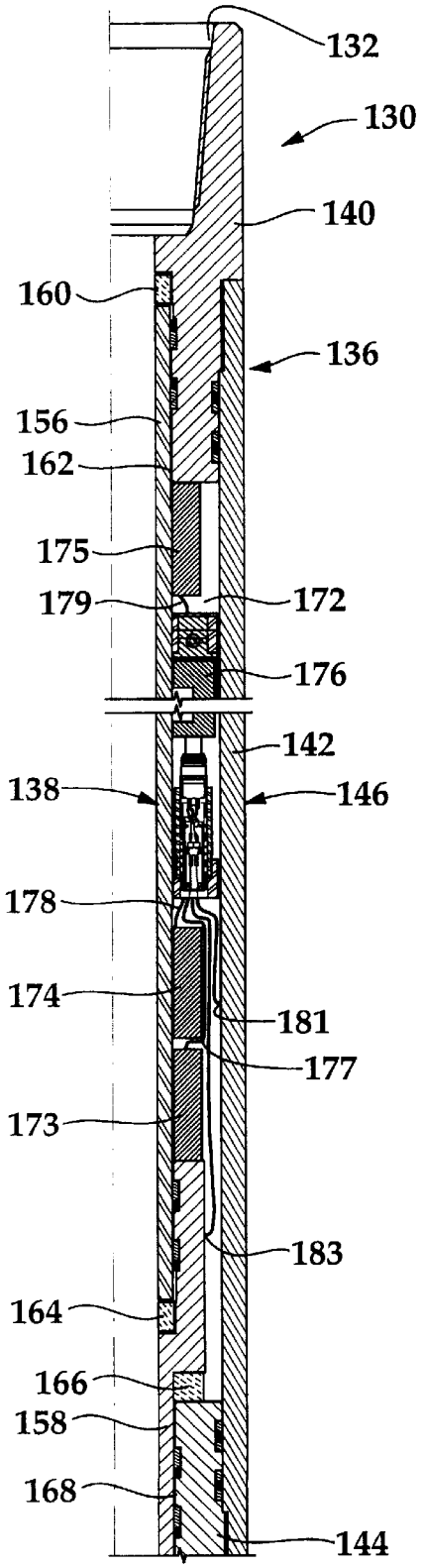
FIGS. 3A–3B are quarter-sectional views of an electromagnetic and acoustic repeater of the present invention.
Figure 3B:
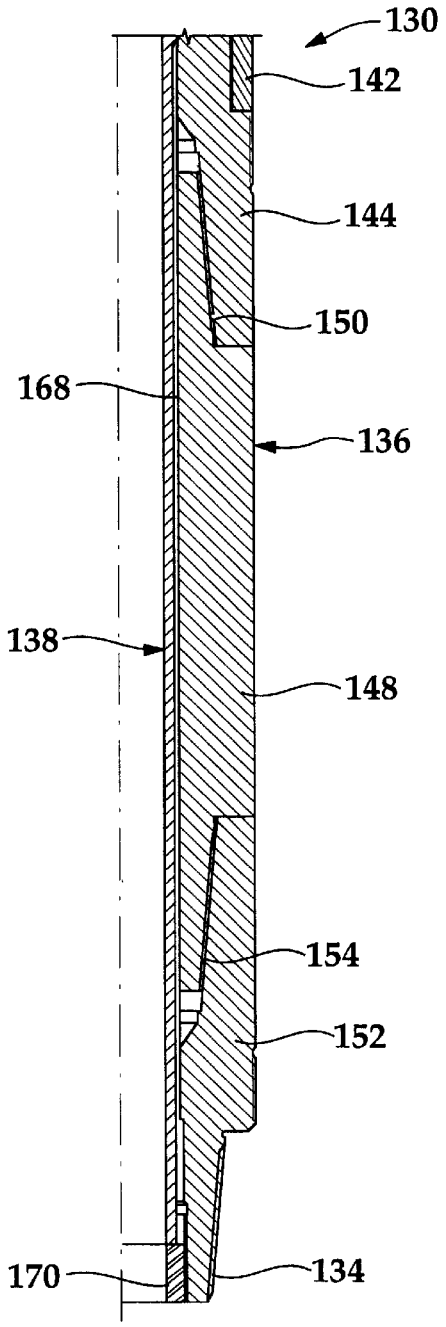

Representatively illustrated in FIGS. 3A–3B is repeater 130 of the present invention depicted in a quarter sectional View for convenience of illustration. Repeater 130 has a box end 132 and a pin end 134 such that repeater 130 is threadably adaptable to drill string 30. Repeater 130 has an outer housing 136 and a mandrel 138 such that repeater 130 may be interconnected with drill string 30 providing a circulation path for fluids therethrough and therearound. Housing 136 and mandrel 138 thereby protect to operable components of repeater 130 from drilling mud or other fluids disposed within wellbore 40 and within drill string 30.

Housing 136 of repeater 130 includes an axially extending and generally tubular upper connecter 140 which has box end 132 formed therein. Upper connecter 140 may be threadably and sealably connected to drill string 30 for conveyance into wellbore 40.

An axially extending generally tubular intermediate housing member 142 is threadably and sealably connected to upper connecter 140. An axially extending generally tubular lower housing member 144 is threadably and sealably connected to intermediate housing member 142. Collectively, upper connecter 140, intermediate housing member 142 and lower housing member 144 form upper subassembly 146. Upper subassembly 146, including upper connecter 140, intermediate housing member 142 and lower housing member 144, is electrically connected to the section of drill string 30 above repeater 130.

An axially extending generally tubular isolation subassembly 148 is securably and sealably coupled to lower housing member 144. Disposed between isolation subassembly 148 and lower housing member 144 is a dielectric layer 150 that provides electric isolation between lower housing member 144 and isolation subassembly 148. Dielectric layer 150 is composed of a dielectric material chosen for its dielectric properties and capably of withstanding compression loads without extruding.

An axially extending generally tubular lower connecter 152 is securably and sealably coupled to isolation subassembly 148. Disposed between lower connecter 152 and isolation subassembly 148 is a dielectric layer 154 that electrically isolates lower connecter 152 from isolation subassembly 148. Lower connecter 152 is adapted to threadably and sealably connect to drill string 30 and is electrically connected to the portion of drill string 30 below repeater 130.

Isolation subassembly 148 provides a discontinuity in the electrical connection between lower connecter 152 and upper subassembly 146 of repeater 130, thereby providing a discontinuity in the electrical connection between the portion of drill string 30 below repeater 130 and the portion of drill string 30 above repeater 130.

Mandrel 138 includes axially extending generally tubular upper mandrel section 156 and axially extending generally tubular lower mandrel section 158. Upper mandrel section 156 is partially disposed and sealing configured within upper connecter 140. A dielectric member 160 electrically isolates upper mandrel section 156 and upper connecter 140. The outer surface of upper mandrel section 156 has a dielectric layer 162 disposed thereon. Dielectric layer 162 may be, for example, a teflon layer. Together, dielectric layer 162 and dielectric member 160 service to electrically isolate upper connecter 140 from upper mandrel section 156.

Between upper mandrel section 156 and lower mandrel section 158 is a dielectric member 164 that, along with dielectric layer 162 serves to electrically isolate upper mandrel section 156 from lower mandrel section 158. Between lower mandrel section 158 and lower housing member 144 is a dielectric member 166. On the outer surface of lower mandrel section 158 is a dielectric layer 168 which, along with dielectric member 166 provide for electric isolation of lower mandrel section 158 with lower housing member 144. dielectric layer 168 also provides for electric isolation between lower mandrel section 158 and isolation subassembly 148 as well as between lower mandrel section 158 and lower connecter 152. Lower end 170 of lower mandrel section 158 is disposed within lower connecter 152 and is in electrical communication with lower connecter 152. Intermediate housing member 142 of outer housing 136 and upper mandrel section 156 of mandrel 138 define annular area 172. A receiver 173, receiver 174, transmitter 175 and an electronics package 176 are disposed within annular area 172.

In operation, receiver 173 receives an acoustic input signal carrying information which is transformed into an electrical signal that is passed onto electronics package 176 via electrical conductor 177. Receiver 174 receives an electromagnetic input signal carrying information which is transformed into an electrical signal that is passed onto electronics package 176 via electrical conductor 178.

Electronics package 176 may select the stronger of the two signals for retransmission or may process both the received electromagnetic signal and acoustic signal. In either approach, electronics package 176 processes and amplifies the electrical signal for retransmission as will be more fully discussed with reference to FIG. 12. Electronics package 176 sends the electrical signal to transmitter 175 via electrical conductor 179 wherein the electrical signal is transformed into an acoustic output signal carrying information that is transmitted via drill string 30. Electronics package 176 also generates an output voltage is applied between intermediate housing member 142 and lower mandrel section 158, which is electrically isolated from intermediate housing member 142 and electrically connected to lower connector 152, via terminal 181 on intermediate housing member 142 and terminal 183 on lower mandrel section 158. The voltage applied between intermediate housing member 142 and lower connector 152 generates the electromagnetic output signal that is radiated into the earth carrying information.

Alternatively, it should be noted by one skilled in the art that receiver 173 may not only serve as an acoustic receiver but may also, in some embodiments, serve as an acoustic transmitter. Likewise, receiver 174 may not only server as an electromagnetic receiver but may also, in some embodiments of the present invention, serve as an electromagnetic transmitter.

Figure 4:
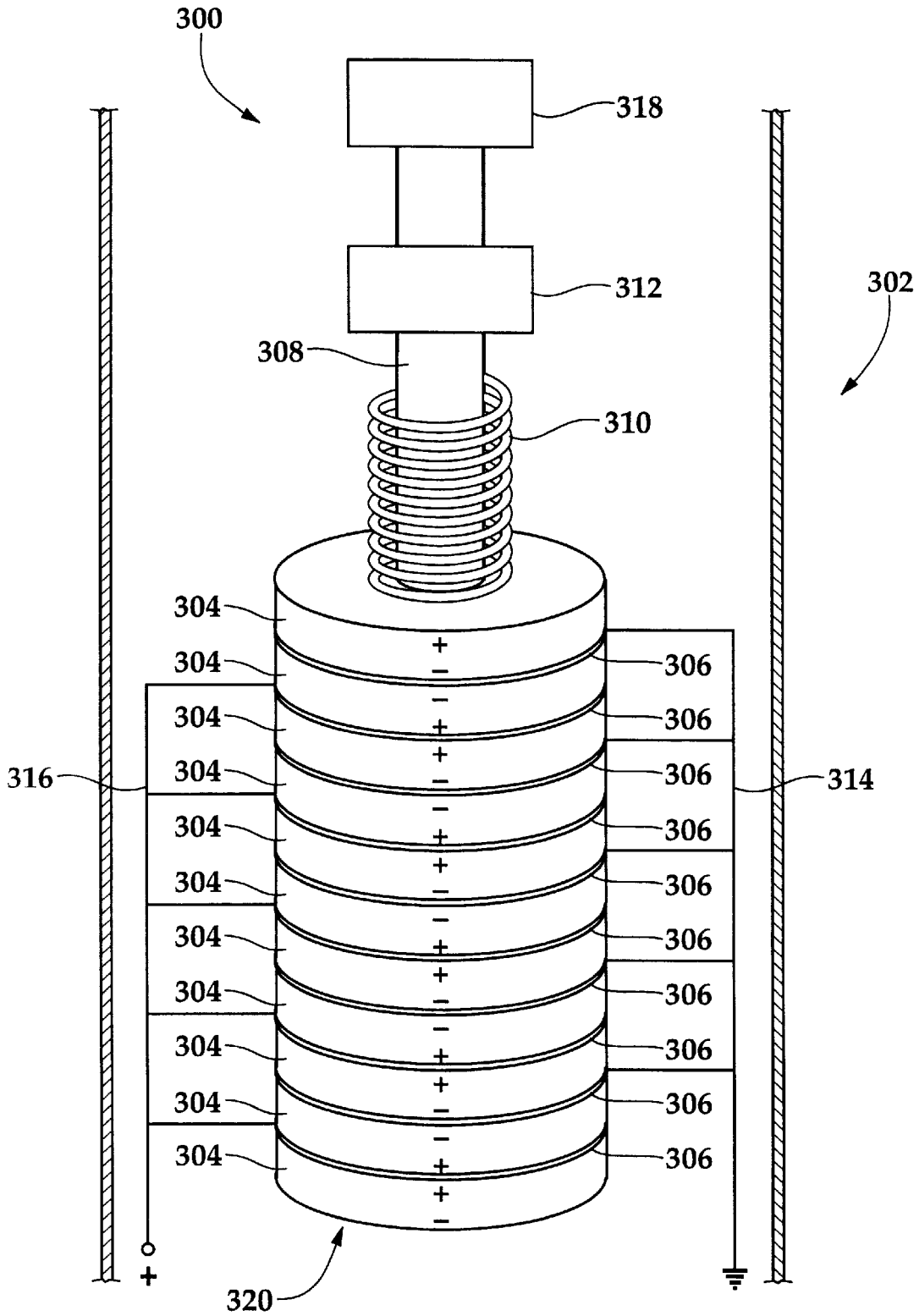
FIG. 4 is an isometric view of an acoustic transmitter or receiver for an electromagnetic and acoustic repeater of the present invention.

Referring now to FIG. 4, an acoustic assembly 300 of the present invention is generally illustrated. As should be appreciated by those skilled in the art, acoustic assembly 300 may be generally positioned and deployed, for example, in repeater 76 of FIG. 2A as transmitter 124 or may be generally positioned and deployed in repeater 76 of FIG. 2A as receiver 120. For convenience of description, the following will describe the operation of acoustic assembly 300 as a transmitter. Acoustic assembly 300 includes a generally longitudinal enclosure 302 in which is disposed a stack 320 of piezoelectric ceramic crystal elements 304. The number of piezoelectric elements utilized in the stack 320 may be varied depending upon a number of factors including the particular application, the magnitude of the anticipated signal and the particular materials selected for construction of acoustic assembly 300. As illustrated, piezoelectric crystal elements 304 are positioned on a central shaft 308 and biased with a spring 310. A reaction mass 312 is mounted on the shaft 308. The piezoelectric crystal elements 304 and shaft 308 are coupled to a block assembly 318 for transmission of acoustic signals.

The piezoelectric crystal elements 304 are arranged such that the crystals are alternately oriented with respect to their direction of polarization within the stack 320. The piezoelectric crystal elements 304 are separated by thin layers of conductive material 306 such as copper so that voltages can be applied to each crystal. Alternating layers 306 are connected to a negative or ground lead 314 and a positive lead 316, respectively. Voltages applied across leads 314 and 316 produce strains in each piezoelectric crystal element 304 that cumulatively result in longitudinal displacement of the stack 320. Displacements of the stack 320 create acoustic vibrations which are transmitted via block assembly 318 to drill string 30 so that the vibrations are transmitted and travel through the various elements of drill string 30.

Acoustic vibrations generated by acoustic assembly 300 travel through the drill string 30 to another acoustic assembly 300 which serves as an acoustic receiver, such as receiver 120. Acoustic assembly 300 then transforms the acoustic vibrations into an electrical signal for processing.

Figure 5:
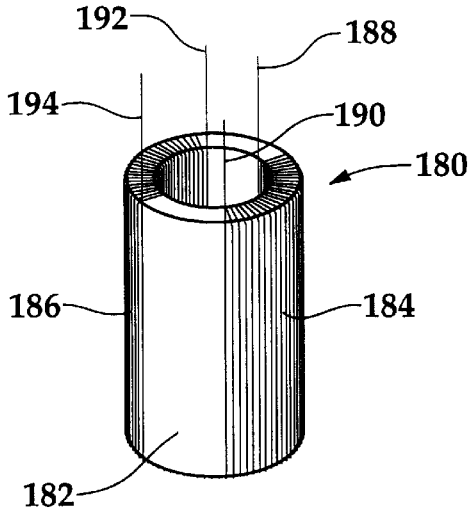
FIG. 5 is a schematic illustration of a toroid having primary and secondary windings wrapped therearound for an electromagnetic and acoustic repeater of the present invention.

Referring now to FIG. 5, a schematic illustration of a toroid is depicted and generally designated 180. Toroid 180 includes magnetically permeable annular core 182, a plurality of electrical conductor windings 184 and a plurality of electrical conductor windings 186. Windings 184 and windings 186 are each wrapped around annular core 182. Collectively, annular core 182, windings 184 and windings 186 serve to approximate an electrical transformer wherein either windings 184 or windings 186 may serve as the primary or the secondary of the transformer.

In one embodiment, the ratio of primary windings to secondary windings is 2:1. For example, the primary windings may include 100 turns around annular core 182 while the secondary windings may include 50 turns around annular core 182. In another embodiment, the ratio of secondary windings to primary windings is 4:1. For example, primary windings may include 10 turns around annular core 182 while secondary windings may include 40 turns around annular core 182. It will be apparent to those skilled in the art that the ratio of primary windings to secondary windings as well as the specific number of turns around annular core 182 will vary based upon factors such as the diameter and height of annular core 182, the desired voltage, current and frequency characteristics associated with the primary windings and secondary windings and the desired magnetic flux density generated by the primary windings and secondary windings as well as the magnetic properties of the earth and the tools surrounding annular core 182.

Toroid 180 of the present invention may serve as an electromagnetic receiver or an electromagnetic transmitter such as receiver 120 and transmitter 124 of FIG. 2A. Reference will therefore be made to FIG. 2A in further describing toroid 180. Windings 184 of toroid 180 have a first end 188 and a second end 190. First end 188 of windings 184 is electrically connected to electronics package 122. When toroid 180 serves as receiver 120, windings 184 serve as the secondary wherein first end 188 of windings 184 feeds electronics package 122 with an electrical signal via electrical conductor 126. The electrical signal may be processed by electronics package 122 as will be further described with reference to FIGS. 9 and 11 below. When toroid 180 serves as transmitter 124, windings 184 serve as the primary wherein first end 188 of windings 184, receives an electrical signal from electronics package 122 via electrical conductor 128. Second end 190 of windings 184 is electrically connected to upper subassembly 92 of outer housing 82 which serves as a ground.

Windings 186 of toroid 180 have a first end 192 and a second end 194. First end 192 of windings 186 is electrically connected to upper subassembly 92 of outer housing 82. Second end 194 of windings 186 is electrically connected to lower connecter 98 of outer housing 82. First end 192 of windings 186 is thereby separated from second end 192 of windings 186 by isolations subassembly 94 which prevents a short between first end 192 and second end 194 of windings 186.

When toroid 180 serves as receiver 120, electromagnetic wave fronts, such as electromagnetic wave fronts 46 at FIG. 1A, induce a current in windings 186, which serve as the primary. The current induced in windings 186 induces a current in windings 184, the secondary, which feeds electronics package 122 as described above. When toroid 180 serves as transmitter 124, the current supplied from electronics package 122 feeds windings 184, the primary, such that a current is induced in windings 186, the secondary. The current in windings 186 induces an axial current on drill string 30, thereby producing electromagnetic waves.

Due to the ratio of primary windings to secondary windings, when toroid 180 serves as receiver 120, the signal carried by the current induced in the primary windings is increased in the secondary windings. Similarly, when toroid 180 serves as transmitter 124, the current in the primary windings is increased in the secondary windings.

Figure 6:
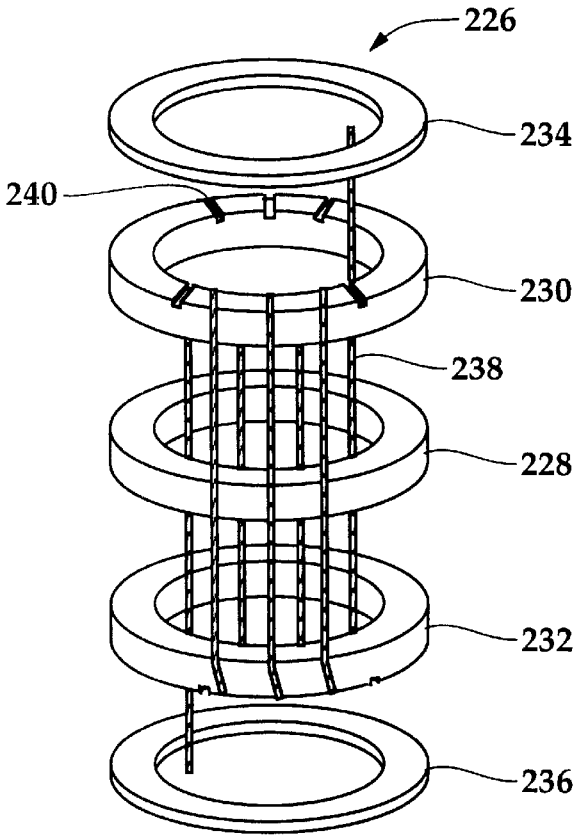
FIG. 6 is an exploded view of one embodiment of a toroid assembly for use as an electromagnetic receiver in an electromagnetic and acoustic repeater of the present invention.

Referring now to FIG. 6, an exploded view of a toroid assembly 226 is depicted. Toroid assembly 226 may be designed to serve, for example, as receiver 120 of FIG. 2A. Toroid assembly 226 includes a magnetically permeable core 228, an upper winding cap 230, a lower winding cap 232, an upper protective plate 234 and a lower protective plate 236. Winding caps 230, 232 and protective plates 234, 236 are formed from a dielectric material such as fiberglass or phenolic. Windings 238 are wrapped around core 228 and winding caps 230, 232 by inserting windings 238 into a plurality of slots 240 which, along with the dielectric material, prevent electrical shorts between the turns of winding 238. For illustrative purposes, only one set of winding, windings 238, have been depicted. It will be apparent to those skilled in the art that, in operation, a primary and a secondary set of windings will be utilized by toroid assembly 226.

Figure 7:
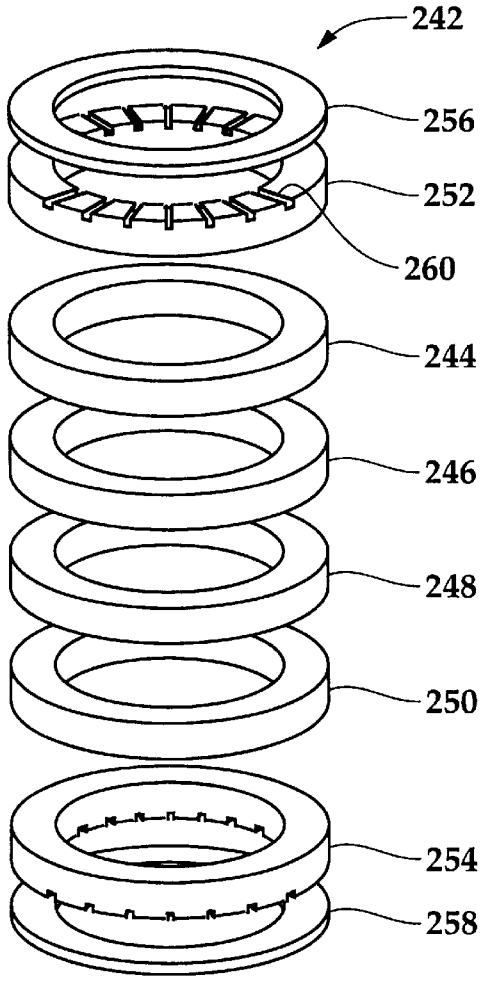
FIG. 7 is an exploded view of one embodiment of a toroid assembly for use as an electromagnetic transmitter in an electromagnetic and acoustic repeater of the present invention.

FIG. 7 depicts an exploded view of toroid assembly 242 which may serve, for example, as transmitter 124 of FIG. 2A. toroid assembly 242 includes four magnetically permeable cores 244, 246, 248 and 250 between an upper winding cap 252 and a lower winding cap 254. An upper protective plate 256 and a lower protective plate 258 are disposed respectively above and below upper winding cap 252 and lower winding cap 254. In operation, primary and secondary windings (not pictured) are wrapped around cores 244, 246, 248 and 250 as well as upper winding cap 252 and lower winding cap 254 through a plurality of slots 260.

As is apparent from FIGS. 6 and 7, the number of magnetically permeable cores such as core 228 and cores 244, 246, 248 and 250 may be varied, dependent upon the required length for the toroid as well as whether the toroid serves as a receiver, such as toroid assembly 226, or a transmitter, such as toroid assembly 242. In addition, as will be known by those skilled in the art, the number of cores will be dependent upon the diameter of the cores as well as the desired voltage, current and frequency carried by the primary windings and the secondary windings, such as windings 238, as well as the magnetic properties of the earth and the tools surrounding toroid assembly 226 or toroid assembly 242.

Figure 8:
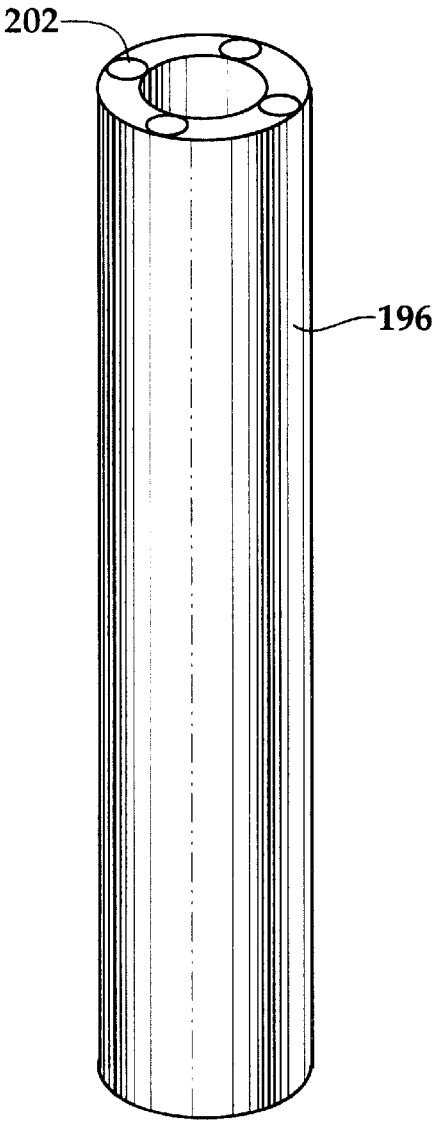
FIG. 8 is a perspective view of an annular carrier of an electronics package for an electromagnetic and acoustic repeater of the present invention.
Figure 9:
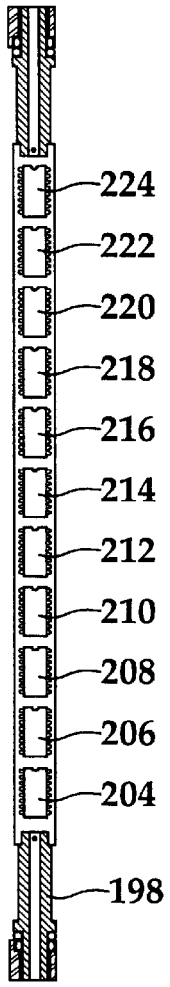
FIG. 9 is a cross-sectional view of an electronics member having a plurality of electronic devices thereon for an electromagnetic and acoustic repeater of the present invention.
Figure 10:
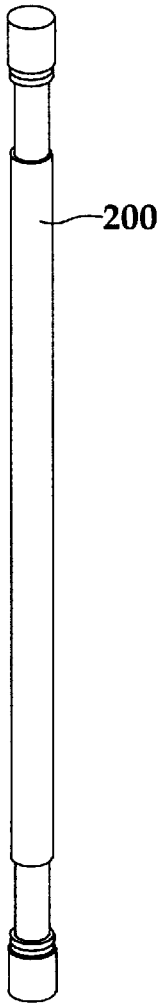
FIG. 10 is a perspective view of a battery pack for an electromagnetic and acoustic repeater of the present invention.

Turning next to FIGS. 8, 9 and 10 collectively and with reference to FIGS. 2A, therein is depicted the components of electronics package 122 of the present invention. Electronics package 122 includes an annular carrier 196, an Electronics member 198 and one or more battery packs 200. Annular carrier 196 is disposed between outer housing 82 and mandrel 84. Annular carrier 196 includes a plurality of axial openings 202 for receiving either electronics member 198 or battery packs 200.

Even though FIG. 8 depicts four axial openings 202, it should be understood by one skilled in the art that the number of axial openings in annular carrier 196 may be varied. Specifically, the number of axial openings 202 will be dependent upon the number of battery packs 200 which will be required for a specific implementation of electromagnetic signal repeater 76 of the present invention.

Electronics member 198 is insertable into an axial opening 202 of annular carrier 196. Electronics member 198 receives an electrical signal from first end 188 of windings 184 when toroid 180 serves as receiver 120. Electronics member 198 includes a plurality of electronic devices such as a preamplifier 204, a limiter 206, an amplifier 208, a notch filter 210, a high pass filter 212, a low pass filter 214, a frequency to voltage converter 216, voltage to frequency converter 218, amplifiers 220, 222, 224. The operation of these electronic devices will be more full discussed with reference to FIG. 11.

Battery packs 200 are insertable into axial openings 202 of axial carrier 196. Battery packs 200 includes batteries such as nickel cadmium batteries, lithium batteries, alkaline batteries or other suitable batteries that are configured to provide the proper operating voltage and current to the electronic devices of electronics member 198 and to, for example, toroid 180.

Even though FIGS. 8–10 have described electronics package 122 with reference to annular carrier 196, it should be understood by one skilled in the art that a variety of configurations may be used for the construction of electronics package 122. For example, electronics package 122 may be positioned concentrically within mandrel 84 using several stabilizers and having a narrow, elongated shape such that a minimum resistance will be created by electronics package 122 to the flow of fluids within drill string 30.

Figure 11:
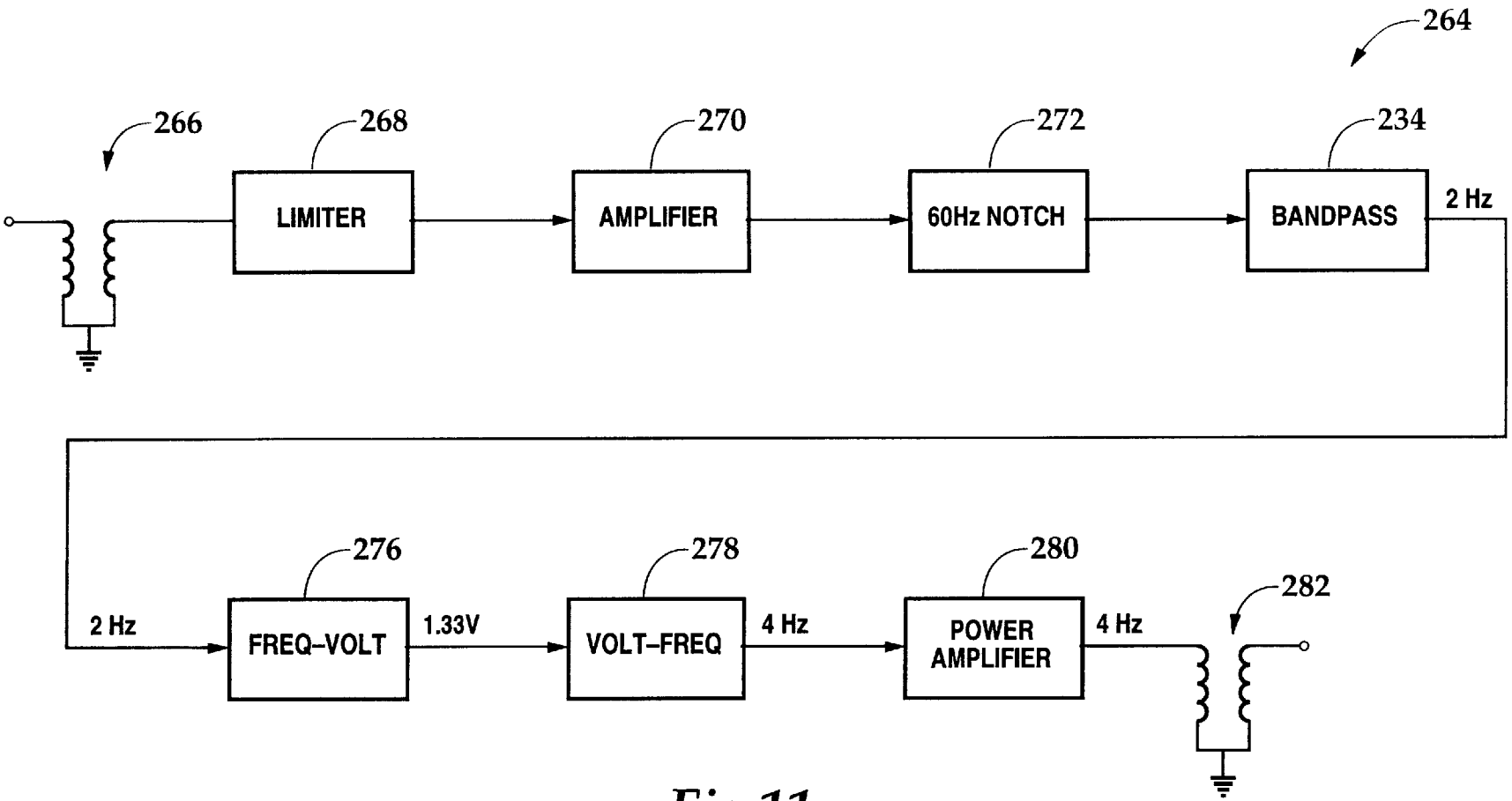
FIG. 11 is a block diagram of a signal processing method of an electromagnetic and acoustic repeater of the present invention.

FIG. 11 is a block diagram of one embodiment of the method for processing the electrical signal by electronics package 122 which is generally designated 264. The method 264 utilizes a plurality of electronic devices such as those described with reference to FIG. 9. Method 264 is an analog pass through process that does not require modulation or demodulation, storage or other digital processing. Limiter 268 receives an electrical signal from receiver 266. Limiter 268 may include a pair of diodes for attenuating the noise to a range between about 0.3 and 0.8 volts. The electrical signal is then passed to amplifier 270 which may amplify the electrical signal to 5 volts. The electrical signal is then passed through a notch filter 272 to shunt noise in the 0 hertz range, a typical frequency for noise in an offshore application in the United States whereas a European application may have of 50 hertz notch filter. The electrical signal then enters a band pass filter 234 to eliminate noise above and below the desired frequency and to recreate a signal having the original frequency, for example, two hertz.

The electrical signal is then fed to a frequency to voltage converter 276 and a voltage to frequency converter 278 in order to shift the frequency of the electrical signal from, for example, 2 hertz to 4 hertz. This frequency shift allows each repeater to retransmit the information carried in the original electromagnetic signal at a different frequency. The frequency shift prevents multiple repeaters from attempting to interpret stray signals by orienting the repeaters such that each repeater will be looking for a different frequency or by sufficiently spacing repeaters along drill string 30 that are looking for a specific frequency.

After the electrical signal has a frequency shift, power amplifier 280 increases the signal which travels to transmitter 282. Transmitter 282 transforms the electrical signal into an electromagnetic signal which is radiated into the earth to another repeater as its final destination.

While the invention has been described in connection with the appended drawings, the description is not to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments within the spirit and scope of the invention.

What is claimed is:

1. A repeater apparatus for communicating information between surface equipment and downhole equipment comprising:

an electromagnetic receiver receiving the information via an electromagnetic input signal and transforming the electromagnetic input signal to a first electrical signal carrying the information;

an acoustic receiver receiving the information via an acoustic input signal and transforming the acoustic input signal to a second electrical signal carrying the information;

an electronics package electrically connected to the electromagnetic receiver and the acoustic receiver, the electronics package processing the first and second electrical signals carrying the information and generating a first electrical output signal carrying the information and a second electrical output signal carrying the information each from a hybrid of the first and second electrical signals;

an electromagnetic transmitter electrically connected to the electronics package, the electromagnetic transmitter transforming the first electrical output signal carrying the information to an electromagnetic output signal carrying the information that is radiated into the earth, thereby electromagnetically retransmitting the information; and an acoustic transmitter electrically connected to the electronics package, the acoustic transmitter transforming the second electrical output signal carrying the information to an acoustic output signal carrying the information, thereby aoustically retransmitting the information.

2. The apparatus as recited in claim 1 wherein the acoustic receiver further comprises a plurality of piezoelectric elements.

3. The apparatus as recited in claim 1 wherein the electronics package further includes a first plurality of electronics devices for processing the first electrical signal and a second plurality of electronics devices for processing the second electrical signal.

4. The apparatus as recited in claim 1 wherein the acoustic transmitter further comprises a plurality of piezoelectric elements.

5. The apparatus as recited in claim 1 wherein the transmitter further comprises a pair of electrically isolated terminals each of which are electrically connected to the electronics package.

6. The apparatus as recited in claim 1 wherein the electronics package compares the first electrical signal to the second electrical signal.

7. The apparatus as recited in claim 6 wherein the electronics package verifies the accuracy of the information carried in the first electrical signal and the second electrical signal.

8. The apparatus as recited in claim 1 wherein the electromagnetic receiver further comprises a magnetically permeable annular core, a plurality of primary electrical conductor windings wrapped axially around the annular core and a plurality of secondary electrical conductor windings wrapped axially around the annular core and magnetically coupled to the plurality of primary electrical conductor windings.

9. The apparatus as recited in claim 8 wherein a current is induced in the primary electrical conductor windings in response to the electromagnetic input signal.

10. The apparatus as recited in claim 9 wherein a current is induced in the plurality of secondary electrical conductor windings by the plurality of primary electrical conductor windings, thereby amplifying the first electrical signal.

11. The apparatus as recited in claim 1 wherein the electromagnetic transmitter further comprises a magnetically permeable annular core, a plurality of primary electrical conductor windings wrapped axially around the annular core and a plurality of secondary electrical conductor windings wrapped axially around the annular core and magnetically coupled to the plurality of primary electrical conductor windings.

12. The apparatus as recited in claim 11 wherein a current carrying the first electrical output signal is inputted in the plurality of primary electrical conductor windings from the electronics package.

13. The apparatus as recited in claim 12 wherein a current is induced in the plurality of secondary electrical conductor windings by the plurality of primary electrical conductor windings such that the electromagnetic output signal is radiated into the earth.

14. A method for communicating information between surface equipment and downhole equipment comprising:

receiving the information via an electromagnetic input signal on an electromagnetic receiver disposed within a wellbore;

transforming the electromagnetic input signal into a first electrical signal carrying the information;

receiving the information via an acoustic input signal on an acoustic receiver disposed within the wellbore;

transforming the acoustic input signal into a second electrical signal carrying the information;

processing the first and second electrical signals carrying the information in an electronics package to generate a first electrical output signal carrying the information and a second electrical output signal carrying the information each from a hybrid of the first and second electrical signals;

transforming the first electrical output signal carrying the information into an acoustic output signal carrying the information in an acoustic transmitter;

acoustically retransmitting the information;

transforming the second electrical output signal carrying the information into an electromagnetic output signal carrying the information; and electromagnetically retransmitting the information.

15. The method as recited in claim 14 wherein the step of transforming the electromagnetic input signal further comprises the steps of inducing a current in a plurality of primary electrical conductor windings wrapped axially around an annular core and amplifying the electromagnetic input signal by magnetically coupling the plurality of primary electrical conductor windings to the plurality of secondary electrical conductor windings wrapped axially around the annular core.

16. The method as recited in claim 14 wherein the acoustic receiver further comprises a plurality of piezoelectric elements.

17. The method as recited in claim 14 wherein the step of transforming the first electrical output signal into an acoustic output signal further comprises applying a voltage to a plurality of piezoelectric elements.

18. The method as recited in claim 14 wherein the step of transforming the second electrical output signal into an electromagnetic output signal further comprises applying a voltage between a pair of electrically isolated terminals each of which are electrically connected to the electronics package.

19. The method as recited in claim 14 wherein the step of transforming the electrical signal into an electromagnetic output signal further comprises the steps of supplying a current to a plurality of primary electrical conductor windings wrapped axially around an annular core and amplifying the electromagnetic input signal by magnetically coupling the plurality of primary electrical conductor windings to a plurality of secondary electrical conductor windings wrapped axially around the annular core.

20. The method as recited in claim 14 wherein the step of processing the first and second electrical signals further comprises comparing the first electrical signal to the second electrical signal.

21. The method as recited in claim 20 further comprising the step of verifying accuracy of the information carried in the first electrical signal and the second electrical signal.

* * * * *